US005666757A

United States Patent [19]

Helmstadter

[11] Patent Number: 5,666,757

[45] Date of Patent: Sep. 16, 1997

[54] COMBINATION OF PISTOL AND RIFLE SHOOTING REST

[76] Inventor: Glenn D. Helmstadter, 381 Niagra Dr., North Huntingdon, Pa. 15642

[21] Appl. No.: 517,217

[22] Filed: Aug. 21, 1995

[51] Int. Cl.[6] ..... F41A 35/00

[52] U.S. Cl. ..... 42/94

[58] Field of Search ..... 42/94; 89/37.04; 248/125.1, 122.1, 176.1, 176.3; 403/161, 146, 119, 389

[56] References Cited

U.S. PATENT DOCUMENTS

| | | | |
|---|---|---|---|
| 2,372,111 | 3/1945 | Norberg | 248/125.1 |
| 2,458,608 | 1/1949 | Lea | 89/37 |
| 3,012,350 | 12/1961 | Wold | 42/94 |
| 3,081,507 | 3/1963 | Gribble | 403/389 |
| 3,358,504 | 12/1967 | Freebairn | 73/167 |
| 3,576,084 | 4/1971 | Anderson, Jr. | 42/94 |
| 4,007,554 | 2/1977 | Helmstadter | 42/94 |
| 4,017,997 | 4/1977 | Peterson et al. | 42/94 |
| 4,018,104 | 4/1977 | Bland et al. | 403/146 |
| 4,055,017 | 10/1977 | Thompson | 42/94 |
| 4,207,699 | 6/1980 | Hensley | 42/94 |
| 4,345,398 | 8/1982 | Pickett | 42/94 |
| 4,438,581 | 3/1984 | La Valle | 42/94 |
| 4,676,021 | 6/1987 | Groba | 42/94 |
| 4,807,381 | 2/1989 | Southard | 42/94 |
| 4,819,359 | 4/1989 | Bassett | 42/94 |
| 4,854,066 | 8/1989 | Canterbury, Sr. | 42/94 |
| 5,070,636 | 12/1991 | Mueller | 42/94 |
| 5,081,782 | 1/1992 | Wright | 42/94 |
| 5,081,783 | 1/1992 | Jarvis | 42/94 |
| 5,181,335 | 1/1993 | Todd | 248/125.1 |
| 5,274,940 | 1/1994 | Guzy | 42/94 |
| 5,275,364 | 1/1994 | Burger et al. | 248/122.1 |
| 5,375,337 | 12/1994 | Butler | 42/94 |

*Primary Examiner*—Michael J. Carone
*Assistant Examiner*—Theresa M. Wesson
*Attorney, Agent, or Firm*—John B. Sotak

[57] ABSTRACT

A universally adjustable lightweight pistol and rifle rest having a tapered metal rod member and a sharped foot engaging member for affixation to the ground and having a movable two-point non-metallic gun supporting member for holding either the pistol or the rifle and being vertically positioned upwardly and downwardly along the length of the metal rod member and being quickly and easily angularly turned and elevationally moved to readily sight-in the rifle or pistol.

20 Claims, 2 Drawing Sheets

COMBINATION OF PISTOL AND RIFLE SHOOTING REST

SUBJECT OF THE INVENTION

This invention pertains to a new and improved universally adjustable gun support and more particularly to a unique lightweight pistol and rifle rest employing a unipod having a pointed end carrying a foot accommodating member for pushing it into the earth and having a vertically rotationally and elevationally movable cross-piece member which includes a forward U-shaped assembly or cradle member has a dual function for holding both the barrel of a pistol or a rifle, a rearward U-shaped assembly or cradle member for holding the butt of the rifle, and an intermediate flat plate or platform member for holding the handle of the pistol.

BACKGROUND OF THE INVENTION

In the opinion of many seasoned hunters and target shooters, the unsteadiness of the shooter is one of the most influential elements which takes away from the shooting ability of sportsmen. That is, the flexibility and wavering of an unsupported gun does not lend itself to the normal unerring and accurate shooting of a piston or rifle. The least amount of movement or flexure can materially affect the shooting accuracy that is necessary for achieving success in target shooting or game hunting. For example, in target shooting or hunting, it is common practice to avoid as much of the human factor as possible by employing a pistol or rifle rest to obtain greater accuracy. Likewise, in sighting-in of pistols and rifles, it is advantageous to utilize a gun rest to obtain the best results. In order to achieve the highest degree of accuracy, it is important to avoid as much human intervention as possible during the actual shooting of the pistol or rifle. Further, the gun rest should provide an independent and stable support for the pistol or rifle without the aid of the shooter so that he or she may freely search out game with a pair of binoculars or alternatively, he or she may readily check the target hits with a spotting scope. In addition, a suitable gun support should also be capable of providing a multitude of vertical positions so that the shooter may selectively fire from a kneeling, sitting or prone position. Further, an appropriate gun rest should permit a full range of coverage both in a horizontal as well as in an elevational direction so that the gun may be freely moved to follow an animal or a target. Additionally, the gun rest should be capable of withstanding severe and adverse weather conditions, such as, rain, sleet, hail and snow, which may be encountered during outdoor shooting events and hunting. Further, the gun rest should be rugged, lightweight and portable since the trips through fields, forests and mountains can be long and hard. In addition to rigidly holding the pistol or rifle in place, the gun support should allow easy placement of the gun while preventing scratching and marring of the wooden stock and metallic barreled action of the pistol or rifle along with any attached scope.

OBJECTS AND SUMMARY OF THE INVENTION

Accordingly, it is an object of this invention to provide a new and improved pistol and rifle rest which independently and securely supports a gun for increasing the shooting accuracy of a sportsman.

Another object of this invention is to provide a unique adjustable gun rest which may be quickly and easily set into the ground for supporting a pistol or rifle.

A further object of this invention is to provide a novel steady pistol and rifle support having a pointed unipod member and a foot accommodating for ground affixation and having an adjustable cross-piece member for firmly holding a gun for a shooter.

Still another object of this invention is to provide an adjustable pistol and rifle rest having a vertical ground piercing rod member and a horizontal gun support arrangement which is movable along the length of the vertical rod member and which is angularly rotatable and elevationally pivotable to permit a shooter to facilely line up a target.

Still a further object of this invention is to provide a unique pistol and rifle rest which is rugged, lightweight and portable for easy carrying and is quickly adjusted to the desired shooting position.

Yet another object of this invention is to provide an improved pistol and rifle support including a step-on member to drive a pointed vertical shaft into the ground and also including a universally gun accommodating member for supporting a pistol or rifle.

Yet a further object of this invention is to provide a highly stable pistol and rifle rest which provides the sole support for a pistol or rifle yet affords a shooter a wide margin of adjustment and manipulation to permit the shooter to quickly and easily sight in on a target.

An additional object of this invention is to provide a new and improved pistol and rifle support which is economical in cost, simple in construction, dependable in service, durable in use and efficient in operation.

In the attainment of the foregoing objects, there is provided a highly reliable pistol and rifle rest having an elongated metallic unipod member which is pointed at one end. A lateral plate member is welded onto the lower end of the elongated metallic unipod member for driving the pointed end into the ground. A gun supporting member including an apertured sleeve member freely movable along the length of the elongated metallic unipod member. A locking member also slidedly fits onto the metallic unipod member and co-acts with the sleeve member to vary the height of the gun supporting member. The locking member includes a threaded hole for receiving the threaded end of an L-shaped lock screw which engages the outer surface of the unipod member and acts as a stop for the sleeve member. The gun supporting member includes a long slender non-metallic body member which is pivotally connected to the apertured sleeve member by a threaded stud. A flat washer and a belleville spring washer are situated on each side of a hole in the long slender body member to provide frictional drag when a nut is screwed into the threaded stud and tightened to the proper torque. The gun supporting member includes a forward upstanding U-shaped cradle member and a rearward upstanding U-shaped cradle member located at the respective ends thereof. The innersides of the cradle members are covered by soft pliable material which protects the gun finish from being marred or scratched. The rear butt portion of a rifle sits into the rearward cradle member while the front barrel portion of the rifle fits into the front cradle member. The two-point contact allows the rifle to sit steadily on the cradle members without the aid or assistance of the shooter. The gun supporting member also includes an intermediate flat plate-like member which is secured to the top of the gun supporting member and is covered by a soft pliable protective material. Thus, a pistol may be free standing by placing the front barrel portion into the front cradle member and sitting the handle on the top of the flat plate-like member. The pivotal connection allows the shooter to freely change the elevation and angular position of the gun supporting member and, in turn, permits the shooter to quickly and accurately sight-in a target.

Other and further objects and advantages of the present invention will become more readily apparent from the following detailed description of the preferred embodiment described with reference to the accompanying drawings which form a part of this specification, in which.

Figure 1:
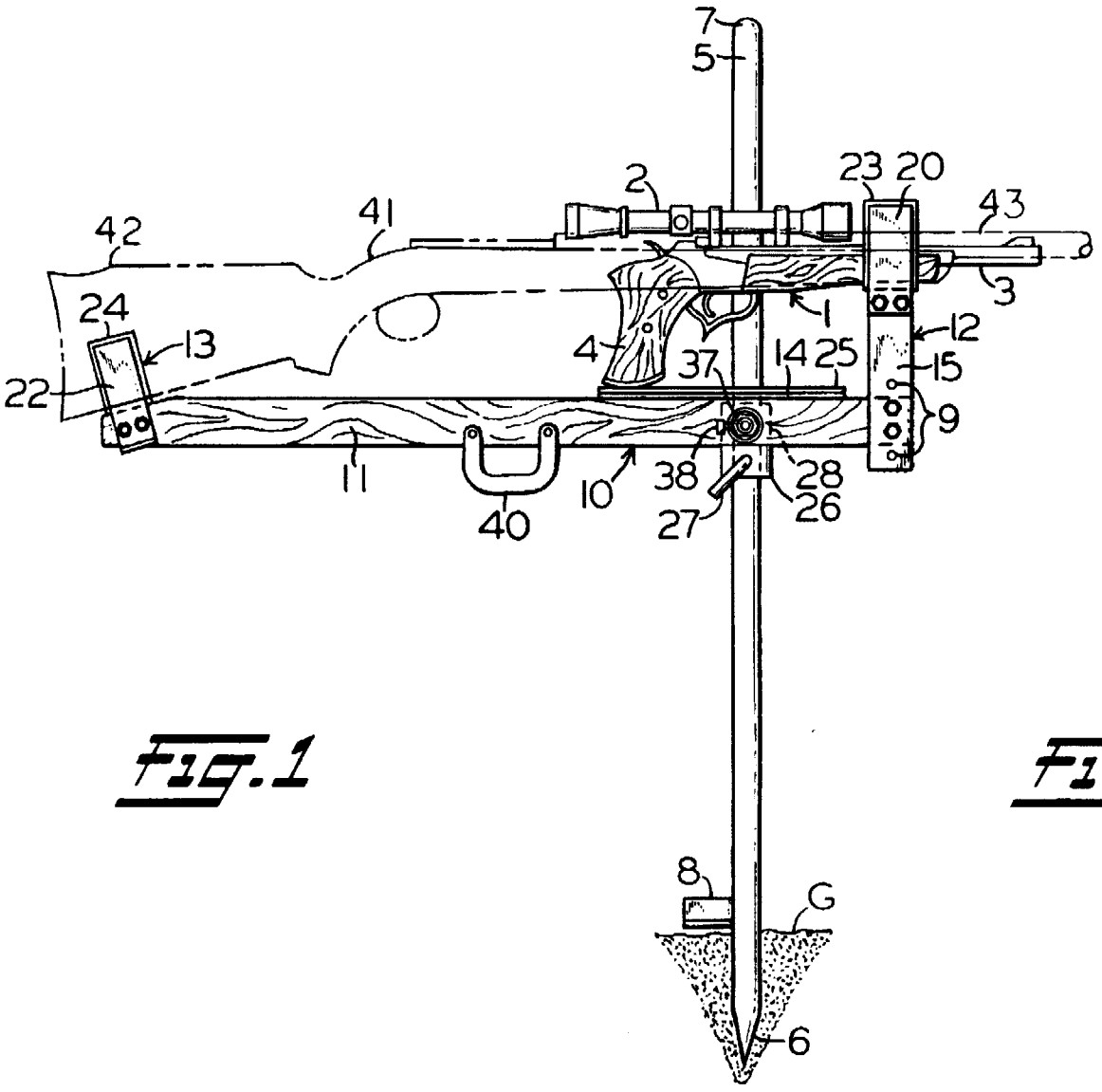
FIG. 1 is a side elevational view of a gun rest embodying the present invention in an operative upright condition showing a scoped pistol in its ready shooting position.

Referring now to the drawings and.in particular to FIG. 1, there is shown a gun rest in accordance with the present invention having a pistol 1 mounted thereon. In varmint hunting and target shooting, the pistol 1 is preferably equipped with a scope 2 to attain maximum spotting and to achieve greater accuracy. The pistol 1 includes a front barrel portion 3 and a rear handle portion 4. As shown, the gun rest provides a stable two-point contact support with one contact point at the bottom or butt end of the handle 4 and with the other contact point at the intermediate end of the barrel 3 of the pistol 1.

It will be noted that the pistol and rifle rest includes a single standard or vertical unipod member 5. The elongated unipod member is preferably constructed of a lightweight metallic rod, such as, aluminum or the like, so that the adverse weather effects are minimized. As shown, the lower end 6 of rod 5 is sharpened or pointed to facilitate affixation of the gun rest as will be described in greater detail hereinafter. Conversely, the upper end 7 of the unipod or rod 5 may be smoothed or rounded to permit one to safely grip the top of the standard during affixation and removal.

As shown, a metallic step-on or foot accommodating member 8 is normally situated near the lower pointed extremity of rod 5. The step-on member 8 takes the form of a substantially thick aluminum plate which extends laterally with respect to the axis of rod 5. The lateral extending plate member 8 is suitably attached to the rod 5, such as being welded thereto. It will be appreciated that the position of the step-on member 8 from the end of the point end 6 of the rod 5 is such as to permit deep and stable penetration of the rod 5 into the soil. That is, the underside step-on member 8 may be tapered or sharpened to allow the pointed end 6 to be easily and quickly depressed and driven into the ground by the shooter or hunter. In other words, the shooter simply places his or her foot onto the step-on member 8 so that the force of his or her weight pushes the rod 5 into the ground until the knife-edge of the plate 8 digs into and slightly penetrates the top surface of the ground as shown in FIG. 1. This surface bearing contact and penetration increases the stability of the entire gun rest.

Figure 2:
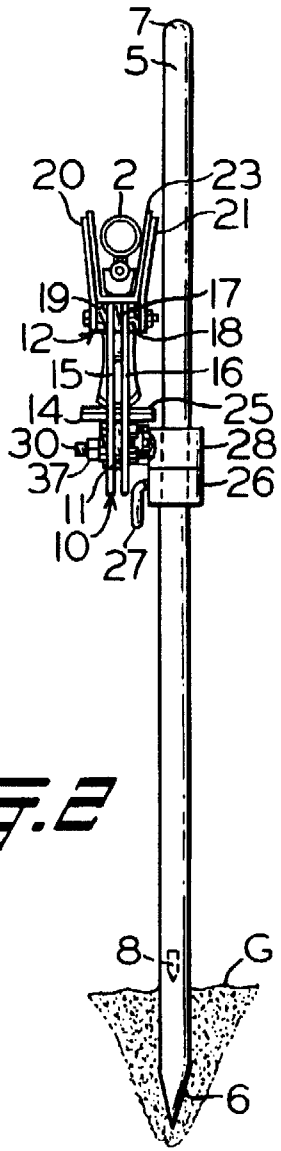
FIG. 2 is a front end view of the gun rest looking into the barrel end of the pistol of FIG. 1.
Figure 4:
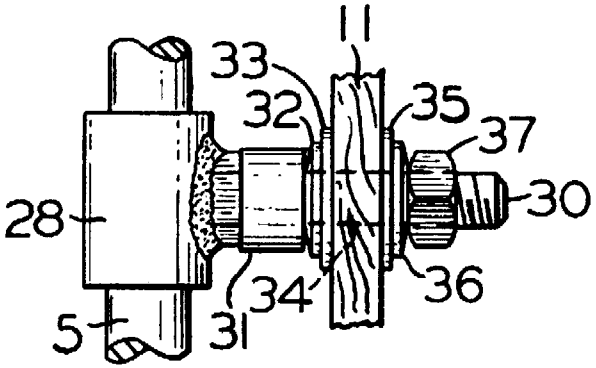
FIG. 4 is an enlarged side view of the physical connection between the body member and the unipod member of the gun rest.
Figure 3:
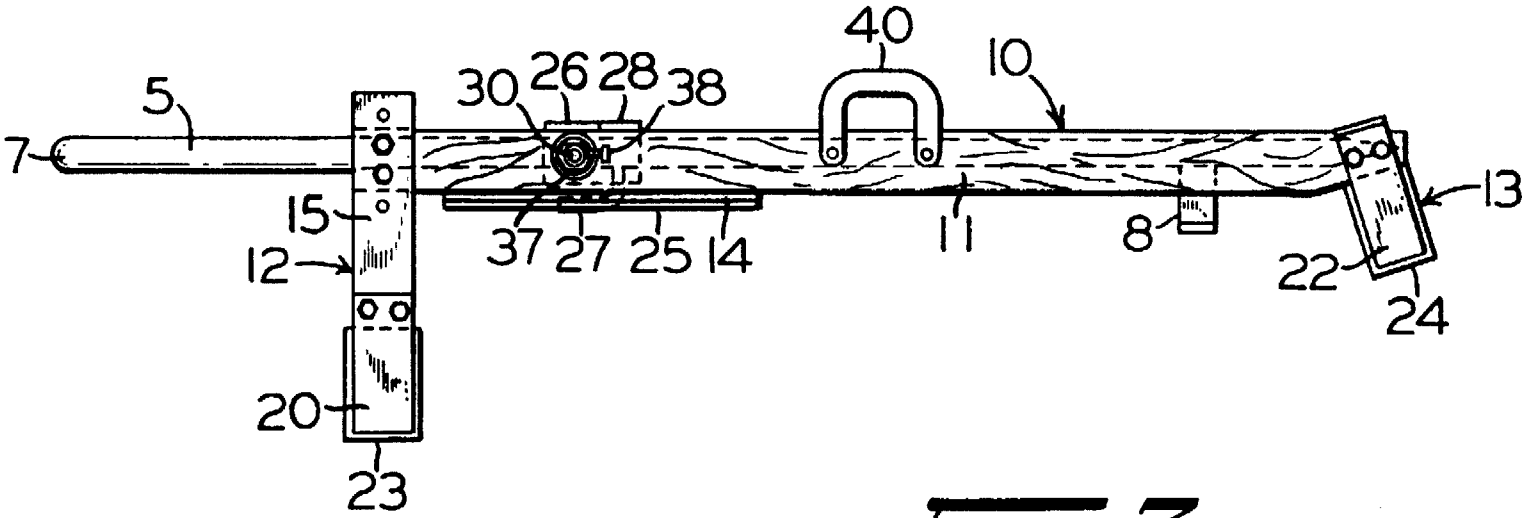
FIG. 3 is a side elevational view of the gun rest in its folded carrying position with the pistol omitted.

In viewing FIGS. 1 and 2, it will be seen that the pistol 1 is entirely supported and carried by a lateral gun supporting member generally characterized by numeral 10. The gun supporting member 10 includes a long, slender, hard fibrous slat-like body member 11 which is pivoted intermediate its end and which is shown as being disposed substantially horizontal to the surface of the ground G. Again, in viewing FIGS. 1 and 2, it will be noted that the one or forward end of the non-metallic lightweight body supporting member 11 includes a front cradle member 12, a rear cradle member 13, and an intermediate bearing member 14. The front cradle member 12 includes a pair of relatively short upstanding aluminum bars 15 and 16 which are secured at their lower end to the frontal end of the weatherproofed plywood or reinforced plastic body member 11 by a pair of suitable bolts which are inserted into two of a plurality of vertical holes 9 and a pair of associated nuts (not characterized). The plurality of vertical holes 9 allow the front cradle member 12 to be vertically adjusted relative to the body member 11 to accommodate various barrel heights. The upper end of bars 15 and 16 accommodate three spacer blocks 17, 18 and 19, and a pair of diverging aluminum plate elements 20 which form a U-shaped or yoke member. The wooden spacers and aluminum elements of the frontal yoke member are secured to the upper end of aluminum bars 15 and 16 by suitable fasteners such as a pair of bolts and nuts (not characterized). Additional spacers may be added to accommodate wider forearms or spacer 17 or spacers 18 and 19 may be removed, if desired. That is, the width of the front cradle member 12 may be increased and decreased by the use of shim members or spacers 17, 18 and 19. In viewing FIG. 1, it will be noted that the back or rearward end of the elongated horizontal body member 11 also includes a U-shaped or yoke member 13 formed by a pair of diverging aluminum plate elements, one of which is characterized by number 22 as shown in FIGS. 1 and 3. The lower ends of the diverging aluminum plates 22 are bolted or otherwise secured to the rearward extremity of wooden body member 11. The front and back yokes 12 and 13 and the flat platform 14 are preferably covered by suitable soft pliable material, such as leather, rubber or vinyl covers 23, 24 and 25, respectively, to protect the wood stock and metallic parts of the pistol or rifle from being marred and scratched during placement and manipulation by the shooter. The gun support member 10 is universally movable in that it may be vertically shifted, angularly rotated and elevationally manipulated. As shown in FIGS. 1 and 2, metallic ring member 26 is fitted onto the unipod member 5 and is selectively moved to any desired height along the length of the elongated metal rod 5. The ring 26 includes a threaded hole which accommodates a suitable fastener such as, an L-shaped screw member 27. The inner end of the screw member 27 cooperates with outer peripheral surface of the aluminum rod 5 to positively lock the ring 26 in position when the screw member 27 is hand-tightened. As shown, the upper surface of the ring member 26 cooperates and communicates with the lower surface of an apertured metallic ring member 28. The sleeve or ring member 28 is fitted onto the rod 5. As shown in FIGS. 2 and 4, the head end of a pivot bolt or stud 30 is welded to the outer peripheral surface of the ring member 28. Next, a hollow aluminum spacer 31 is placed into the threaded end of the bolt or stud 30. Then, a zinc-plated belleville spring washer 32 and a zinc-plated flat washer 33 are situated between the spacer 31 and the inner surface of body member 11. As shown in FIG. 4, the elongated rigid plywood body member 11 includes a circular hole 34 located intermediate the ends thereof. A zinc-coated flat bearing washer 35 and a zinc-coated belleville spring washer 36 are next placed onto the threaded end of bolt 30 and then a nut 37 is screwed onto threaded end of the bolt 30. The compression spring action of the belleville washers 33 and 36 is utilized to increase or decrease the frictional resistance between the contacting surfaces of the flat washers 33 and 36 and the inner and outer contiguous surfaces of the long slender body member 11. When the nut 37 is properly torqued, it may be retained and may be locked in position by a lock screw 38. It will be appreciated that the spring tension of the belleville washers and the frictional drag between washers 33 and 36 and body member 11 may be adjusted by loosening the screw 38 and torquing the nut 37 to the appropriate holding force which is then locked by tightening screw 38. In viewing FIGS. 1 and 3, it will be noted that a carrying hand 40 is secured to the body member 11. As shown in phantom, a rifle 41 may also be entirely supported by the body member 11, namely, a two-point contact between the two yoke members and the butt, and forearm portions 42 and 43 of the rifle 41 makes it unnecessary for the shooter to continuously hold or steady the rifle so that he or she is free to spot the game or varmint with his or her binoculars or to locate the targets hits with his or her spotting scope. A shooter can quickly vary the height for a sitting, kneeling or prone position by loosening the screw member 21 and raising or lowering the ring member 26 and then retightening the screw member 21 in the new height position. It will be appreciated that the shooter can quickly and easily angularly rotate and elevationally move the gun supporting member 11 to bring the pistol or rifle on target. The present invention reduces unsteadiness of the shooter since the weight of the entire gun is completely supported by the gun rest, and only the necessary force is that of pulling the trigger at the moment of firing. Thus, a high degree of accuracy is realized in varmint hunting and/or target shooting by the shooter. After the hunting or target practice session, the sportsperson simply lifts the pistol or rifle from the body supporting member 11, and then grasps the upper end 7 of the rod 5 and removes the pointed end from the ground, rotates the cradle 20 approximately 90° about pivot bolt 30 so that the elongated member is in-line with the longitudinal axis of the rod 5. Thus, the gun rest is relatively compact and easy to carry by the handle 40 and subsequently to store for future shooting sessions. The gun rest is relatively light in weight since the various parts or components are constructed of lightweight metal, weatherproofed high quality plywood, reinforced plastic or the like. Since the gun rest is virtually unaffected by the adverse effects of the weather, it is long lived and requires little, if any, maintenance.

It will be appreciated that various changes, alterations and modifications may be made in the described embodiment of the present gun rest arrangement without departing from the spirit and scope of the subject invention. For example, the nut 37 may be a self-locking nut. Further, the screw member 27 may be replaced by other locking means. Other variations and ramifications will undoubtedly occur to those skilled in the art that are deemed to fall within the purview of the present invention which is intended to be limited only as set forth in the appended claims.

Thus, it is intended and understood that the subject matter disclosed in the foregoing description and shown in the accompanying drawings should be taken and interpreted in an illustrated or diagrammatic sense only.

Having thus described the present invention, what I claim as new and desire to secure by Letters Patent is:

1. A combination of a pistol and rifle rest comprising, an elongated metallic unipod member having a sharpened end and having a step-on plate member for affixation into the ground, a gun supporting member including an apertured sleeve member freely movable along the length of the elongated metallic unipod member, a locking member also slidedly fits onto the metallic unipod member and co-acts with the sleeve member to vary the height of the gun supporting member, the locking member includes a threaded hole for receiving the threaded end of an L-shaped lock screw which engages the outer surface of the unipod member and acts as a stop for the sleeve member, the gun supporting member includes a long slender non-metallic body member which is pivotally connected to the apertured sleeve member by a threaded stud, a flat washer and a belleville spring washer that is situated on each side of a hole in the long slender non-metallic body member to provide frictional drag when a nut is screwed into the threaded stud and tightened to the proper torque, the gun supporting member includes a forward upstanding U-shaped cradle member for supporting the front barrel portion of the pistol and rifle and a rearward upstanding U-shaped cradle member for supporting the rear butt portion of the rifle, the innersides of the cradle members are covered by soft pliable material which protects the gun finish from being marred or scratched, the rear butt portion of a rifle sits into the rearward cradle member while the front barrel portion of the rifle fits into the forward cradle member, the two-point contact allows the rifle to sit steadily on the cradle members without the aid or assistance of the shooter, the gun supporting member also includes an intermediate flat plate-like member for supporting the handle of the pistol, the intermediate flat plate-like member is secured to the top of the gun supporting member and is covered with a soft pliable protective material, the pistol is permitted to stand freely by placing the front barrel portion into the forward cradle member and sitting the handle on the top of the first plate-like member, and the pivotal connection allows the shooter to freely change the elevation and angular position of the gun supporting member and, in turn, permits the shooter to quickly and accurately sight-in a target.

2. The combination of a pistol and rifle rest as defined in claim 1, wherein said elongated unipod member is a long metallic rod.

3. The combination of a pistol and rifle rest as defined in claim 1, wherein said step-on plate member has its underside sharpened to dig into the ground.

4. The combination of a pistol and rifle rest as defined in claim 1, wherein said aperture sleeve member is a metallic ring.

5. The combination of a pistol and rifle rest as defined in claim 1, wherein said locking member is a metallic ring.

6. The combination of a pistol and rifle rest as defined in claim 1, wherein a non-metallic body member is a weatherproofed plywood slat.

7. The combination of a pistol and rifle rest as defined in claim 1, wherein said forward U-shaped cradle member has a dual function of accommodating the barrel portion of a pistol as well as the barrel portion of a rifle.

8. The combination of a pistol and rifle rest as defined in claim 1, wherein said flat and belleville washers are zinc coated.

9. The combination of a pistol and rifle rest as defined in claim 1, wherein said nut is locked into place when properly torqued.

10. The combination of a pistol and rifle rest as defined in claim 9, wherein said nut is locked in place by a lock screw.

11. The combination of a pistol and rifle as defined in claim 1, wherein a carrying handle is attached to said non-metallic body member.

12. The combination of a pistol and rifle rest as defined in claim 1, wherein said intermediate flat plate-like member is substantially long so that the handle of short as well as long-barreled pistols may be effectively seated on said intermediate flat plate-like member.

13. The combination of a pistol and rifle rest as defined in claim 1, wherein said forward cradle member includes a pair of diverging plate elements, spacers and bars which are secured to the front of said gun supporting member.

14. The combination of a pistol and rifle rest as defined in claim 13, wherein the number of spacers may be increased to increase the width of said forward cradle member.

15. A combination of a pistol and rifle rest comprising a metal rod member having a pointed end and having a foot accommodating member for affixation into the ground, a gun supporting member including an apertured sleeve member freely movable along the length of the metal rod member, a locking member also slidedly fits onto the metal rod member and co-acts with the sleeve member to vary the height of the gun supporting member, the locking member includes a threaded hole for receiving the threaded end of a lock screw which engages the outer surface of the metal rod member and acts as a stop for the sleeve member, the gun supporting member includes a long slender hard fibrous body member which is pivotally connected to the apertured sleeve member by a threaded stud, a flat metal washer and a belleville spring washer are situated on each side of a hole formed in the long slender hard fibrous body member to provide pivotal resistance when a nut is screwed into the threaded stud and tightened to the proper torque, the gun supporting member includes a front U-shaped cradle member for supporting the front barrel portion of the pistol and rifle and a rear U-shaped cradle member for supporting the rear but portion of the rifle, the innersides of the cradle members are covered by soft pliable material which protects the gun finish from being marred or scratched, the rear butt portion of a rifle sits into the rear cradle member while the front barrel portion of the rifle fits into the front cradle member, the two-point contact allows the rifle to sit steadily on the cradle members without the aid or assistance of the shooter, the gun supporting member also includes an intermediate flat plate-like member for supporting the handle of the pistol, the intermediate flat plate-like member is secured to the top of the gun supporting member and is covered with a soft pliable protective material, the pistol is permitted to stand freely by placing the front barrel portion into the front cradle member and sitting the handle on the top of the flat plate-like member, and the pivotal connection allows the shooter to freely change the elevation and angular position of the gun supporting member and, in turn, permits the shooter to quickly and accurately sight-in a target.

16. The combination of a pistol and rifle as defined in claim 15, wherein said metal rod member is a round aluminum bar.

17. The combination of a pistol and rifle rest as defined in claim 15, wherein said soft pliable material is leather.

18. The combination of a pistol and rifle rest as defined in claim 15, wherein said hard fibrous body member is made out of plywood.

19. The combination of a pistol and rifle rest as defined in claim 18, wherein said plywood is weather-proofed.

20. The combination of a pistol and rifle rest as defined in claim 15, wherein the width of the front cradle member may be increased and decreased by the use of shim members.

* * * * *